United States Patent [19]

Howe, Jr.

[11] Patent Number: 4,638,913

[45] Date of Patent: Jan. 27, 1987

[54] MULTIPLY PACKAGE HAVING DELAMINATING EASY OPEN SEAL

[75] Inventor: Milton A. Howe, Jr., Spartanburg, S.C.

[73] Assignee: W. R. Grace & Co., Cryovac Div., Duncan, S.C.

[21] Appl. No.: 295,157

[22] Filed: Aug. 21, 1981

[51] Int. Cl.[4] ..... B65D 77/12

[52] U.S. Cl. ..... 206/632; 206/484; 229/48 T; 383/35; 383/94; 383/114; 383/121; 493/215

[58] Field of Search ..... 206/621, 622, 484, 632, 206/633; 229/62, 55, 65, 48 T, 54; 493/212, 214, 215, 927, 930; 53/479, 412, 492; 150/3; 383/107, 94, 121, 109, 35, 114

[56] References Cited

U.S. PATENT DOCUMENTS

| | | | |
|---|---|---|---|
| 2,344,369 | 3/1944 | Salfisberg | 229/55 |
| 2,855,137 | 10/1958 | Simonsen | 229/65 |
| 2,968,396 | 1/1961 | Pratt . | |
| 2,997,166 | 8/1961 | Pratt . | |
| 3,001,689 | 9/1961 | Burton | 229/62 |
| 3,085,738 | 4/1963 | Bok | 229/62 |
| 3,089,635 | 5/1963 | Kugler | 229/62 |
| 3,119,549 | 1/1964 | Schoen . | |
| 3,147,903 | 9/1964 | Lipschutz et al. | 229/62 |
| 3,256,981 | 6/1966 | Kurtz . | |
| 3,423,010 | 1/1969 | Corbett | 383/35 X |
| 3,536,501 | 10/1970 | Work . | |
| 3,596,824 | 8/1971 | Lehmacher et al. | 229/54 |
| 3,623,653 | 11/1971 | Work . | |
| 3,655,503 | 4/1972 | Stanley et al. | 229/48 T |
| 3,688,974 | 9/1972 | Gennerich et al. | 229/54 R |
| 3,741,253 | 6/1973 | Brax et al. . | |
| 3,953,557 | 4/1976 | Brax et al. . | |
| 4,031,162 | 6/1977 | Brax et al. . | |
| 4,117,934 | 10/1978 | Mowli et al. . | |
| 4,126,085 | 11/1978 | Mowli et al. . | |
| 4,138,932 | 2/1979 | Mowli et al. . | |
| 4,174,597 | 11/1979 | Mowli et al. . | |
| 4,278,738 | 7/1981 | Brax et al. | 428/515 |
| 4,286,746 | 9/1981 | Gorshe | 229/55 |

*Primary Examiner*—William Price
*Assistant Examiner*—Bryon Gehman
*Attorney, Agent, or Firm*—John J. Toney; William D. Lee, Jr.; Mark B. Quatt

[57] ABSTRACT

Disclosed is a package for cheese, luncheon meat and the like having an easy open seal. The package comprises a pouch-like receptacle constructed from flexible thermoplastic film having at least two layers wherein the outer surface layer has a tensile strength greater than the bond strength between the outer layer and its adjacent layer. To form the easy open seal the edges of the mouth of the receptacle are folded inwardly, flattened, and a heat seal applied to compress and seal together the resulting four layers of film with the seal being located between the edges and the fold lines. The resulting two folds provide grippable halves which can be pulled apart thereby rupturing one of the outer layers and delaminating the film from the point of rupture to the edge of the film, the delamination occurring between the outer layer and the adjacent layer.

7 Claims, 3 Drawing Figures

MULTIPLY PACKAGE HAVING DELAMINATING EASY OPEN SEAL

FIELD OF INVENTION

This invention relates to packages for cheese, luncheon meat and the like. Specifically, the invention relates to an easy open seal for such packages and further relates to means to close such packages once they are opened.

BACKGROUND

Cheese, luncheon meat, and similar products and commodities are packaged today in a thermoplastic film which is overwrapped about the article to be packaged and the film is heat sealed to itself to form closure seams. After the package is heat sealed it is a problem to open the package without destroying the package and leaving it unsuitable for further use. The problem is compounded because the films for packaging such products as cheese and luncheon meat should be strong and abuse resistant and have desirable gas transmission properties yet at the same time be capable of being opened without destroying the package. Thus, it is a principal object of this invention to provide a closure and seal configuration which is easily opened by a relatively small opening force and does not destroy the package.

Numerous seal configurations have been proposed in the past which employ easy open features. For example, U.S. Pat. No. 2,968,396 shows an opening and separating feature for a thermoplastic film package wherein a gusset type fold provides grippable pull-apart tabs. U.S. Pat. No. 3,536,501 which issued on Oct. 27, 1970 to W. A. Work shows a package in which the edge of the closure flap is floded over so that the outer film layer is sealed to itself. French Pat. No. 1,331,100 which was filed Jan. 22, 1962 naming Mme. Beernaert (formerly Germaine Malard) as inventor shows a package with a closure seal in which the edges of the mouth of the receptacle are folded outwardly and then a heat seal is placed through the four layers of film. U.S. Pat. No. 3,655,503 which was issued on Apr. 11, 1972 to Hugh E. Stanley and George M. Tokos shows a package closure seal in which multilayer films are sealed together and when pulled apart to open the package the outer layer of one film ruptures and delaminates only in the seal area. Another object of the present invention is to provide a package and seal configuration improved over the aforementioned and other presently available designs.

The above objects are achieved by the present invention which is better understood by reference to the following summary of the invention, description of the drawings, and detailed description.

SUMMARY OF THE INVENTION

In one aspect the present invention is: an easy open seal for an opening in a flexible receptacle of thermoplastic film, said film having at least two layers wherein the tensile strength of the outer surface layer is greater than the bond strength between the outer layer and the adjacent layer comprising at least one fold in said film, said fold being adjacent a film edge which forms said opening, said fold providing direct contact between two surface areas of said outer layer; a heat seal between said two surface areas, said seal being located between said fold and said film edge; and said fold providing a tab which may be pulled to rupture one of said outer layers at said seal and causing said outer layer to delaminate from its adjacent layer to the edge of the film thereby opening said receptacle.

In another aspect, the present invention is a package having an easy open seal comprising a product; a receptacle of flexible film enclosing said product, said film having at least two layers, the tensile strength of the outer layer being greater than the bond strength between the outer layer and its adjacent layer; a seal closing one side of the receptacle, said seal being formed by opposed edges of said receptacle inwardly folded over at mating fold lines so that the surfaces of the outer layers of said film are directly sealed to each other and the surfaces of the inner layer of said film are sealed together, all of said surface-to-surface seals being in-line within the same seal area and located between the fold lines and the product whereby the folded over edges provide tabs which may be pulled apart rupturing one of the outer layers and causing it to delaminate from its adjacent layer, said delamination extending from the seal area to the edge of the film thereby opening said receptacle.

The present invention also includes a method of making a package with an easy open closure seal.

DESCRIPTION OF DRAWINGS

Attached hereto and made a part of this disclosure are the drawings showing principal features of the subject invention and in which.

PREFERRED EMBODIMENT

Figure 1:
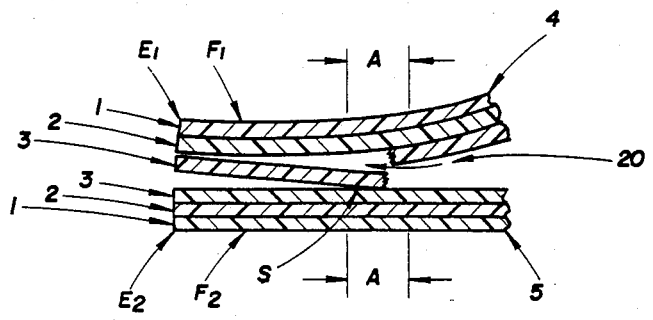
FIG. 1 is an exaggerated schematic representation of the seal area showing rupture of one outer layer and delamination thereof from an adjacent layer.
Figure 2:
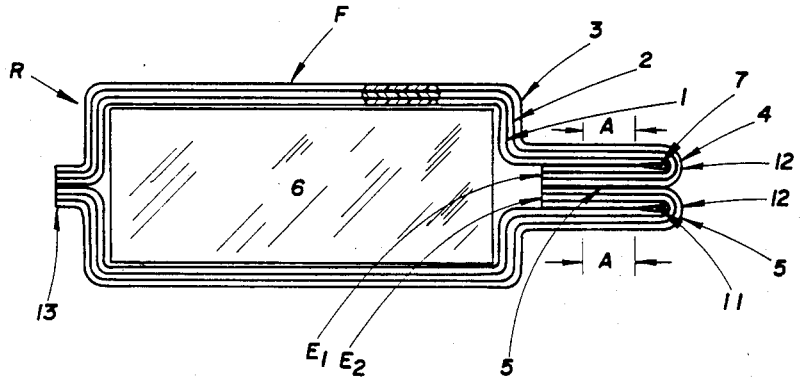
FIG. 2 is a cross-section in exaggerated detail of one embodiment of the package of the present invention; and, FIG. 3 is a top view of the embodiment shown in FIG. 2.

Referring first to FIG. 2 a product 6 which may be cheese or luncheon meat is shown enclosed by multilayer film F. The receptacle made from multilayer film F can be formed in several different manners and may be called a bag, pouch, package, etc. In the preferred embodiment a seamless tube of the three-layer film F is closed at one end by end seal 13 which forms the bottom of bag or receptacle R. The receptacle is loaded with product 6 and, to close the loaded receptacle, an inward fold is made at its open end or mouth along line 12 wherein edges 9 and 10 are folded under so that they mate or coincide when the bag mouth is flattened. In the flattened condition a heat seal is applied by compressing the four layers of material in the seal area region A. All of the surfaces in contact in seal Region A will be sealed to each other. This configuration leaves separable tabs 4 and 5 which may be gripped by the fingers to pull the seal apart. When this occurs rupture and delamination shown in FIG. 1 occurs.

In FIG. 1 seal area A represents the seal which actually closes the opening to the receptacle or bag R. The seal is designated seal S in FIGS. 1 and 2. When tabs 4 and 5 are grasped between the fingers and pulled apart a delamination occurs at the beginning of the seal S in the area A as shown in FIG. 1 and the delamination between layer 3 and its adjacent layer 2 continues to the edge E of the film so that opening 20 now provides access to the interior of the bag through the ruptured outer layer 3 of film F-1 of tab 4 and through the delamination between layer 3 and its adjacent layer 2 which continues to the edge of the film E. From this opening the product 6 may be removed and reinserted into the bag.

Referring to FIG. 1, it is seen that the film F from which the bag is formed is a three-layer film having inner layer 1, middle or adjacent layer 2 and outer layer 3. (In FIG. 2 it can be seen that outer layer 3 is on the outside of the bag.) A preferred three-layer film is that disclosed in U.S. Pat. No. 4,278,738 which issued on July 14, 1981 to Harri J. Brax et al. Relating the Brax et al film to the layers to FIG. 1, inner layer 1 is an ethylene-vinyl acetate copolymer which has been cross linked by irradiaion and has a thickness of approximately 1.5 mils; middle layer 2 is a copolymer of vinylidene chloride having a thickness of approximately 0.2 mils; and outer layer 3 is a crosslinked ethylene vinyl acetate copolymer having a thickness of approximately 0.7 mils. The vinyl acetate content in the ethylene-vinyl acetate copolymers is approximately 10% and the vinylidene chloride copolymer is a copolymer of vinylidene chloride and vinyl chloride in a mixture of 10% suspension polymerized and 90% emulsion polymerized copolymers. The emulsion polymerized copolymer consists of about 70% vinylidene chloride and 30% vinyl chloride and the suspension polymerized copolymer consists of about 80% vinylidene chloride and 20% vinyl chloride.

Figure 3:
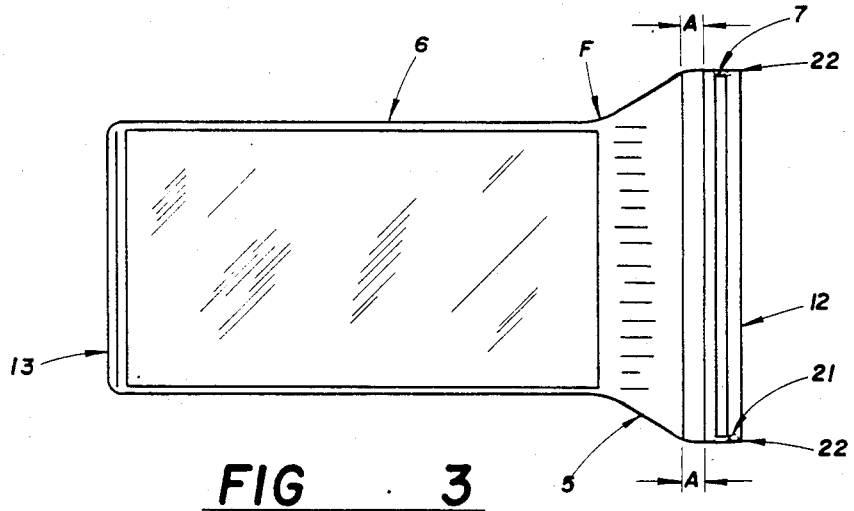

Using the film described above, which is available in a seamless tube so that an end seal 13 can be applied to close the bottom of the bag, the top of the bag when folded in a configuration shown in FIG. 2 has the appearance shown in FIG. 3 when laid flat. In this position, a heat seal can be applied across the width of the bag in area A. The width of the seal is one-eighth inch to one-quarter inch in width and and be applied by a sealing unit such as those made by the Vertrod Corporation of Brooklyn, New York or by any other heat seal unit as these are well known in the art. A pressure of approximately twelve kilograms per centimeter is preferred and the sealing unit is set such that the temperature at the interfaces where sealing occurs is in the range of 225° F. to 300° F. In a laboratory arrangement the total sealing time consists of approximately 0.6 seconds for preheating the seal bars, 0.3 seconds for the heated welding time as the pressure is applied to the area A, and approximately 0.1 seconds for release time. In a production operation the seal bars do not have time to cool and the preheat time will drop to approximately 0.1 second for a total sealing time of approximately 0.5 seconds.

A seal according to the foregoing will keep the package intact and will resist abuse yet the seal can be readily opened by grasping the tabs 4 and 5 of FIG. 2 and pulling them apart whereupon one of the layers 3 as in FIG. 1 ruptures and delaminates to film edge E-1 or E-2. Delamination is observed to occur rather than rerupture of the outer layer 3.

A reclosure feature is provided which can be a "twist-tie" strip or any piece of wire or other material which has dead-fold characteristics. Strip 7 is located within one of the end folds as shown in cross section in FIG. 2 or in the top view in FIG. 3. The dead-fold strip 7 can be inserted by simply punching a hole as indicated by the dotted lines 21 in FIG. 2 and inserting the dead-fold strip into the hole. After the bag has been opened, it can be readily closed by rolling up the said bag material in the area 23 as one rolls up the used end of a tube of toothpaste and then crimping or bending the dead-fold strip to hold the roll of film material 23 secure. Other materials which can be suitably used in the present invention are polyethylene and ethylene-vinyl acetate copolymers in general for the material for the outer layer and for the material of the adjacent layer materials can be selected from the group consisting of nylon, vinylidene chloride copolymers, propylene homopolymers and copolymers; and, cross-linked polyethylene and ethylene-vinyl acetate copolymers. The chief criterion is that the tensile strength or rupture strength of the outer layer is greater than the bond strength between layers 2 and 3. Likewise, the bond strength between layers 2 and 3 has to be less than the rupture or tensile strength of adjacent layer 2 or of the combination of layers 1 and 2.

Other folding configurations are possible within the scope of the present invention as long as the fold results in outer layer 3 being sealed to itself in a face-to-face relationship so that when the rupture occurs there is delamination to a nearby or adjacent edge of the film resulting in an access opening to the interior of the package.

Having thus described my invention, I claim:

1. An easy open seal for an opening in a receptacle of thermoplastic film, said film having at least two layers wherein the tensile or rupture strength of the outer surface layer is greater than the bond strength between the outer layer and its adjacent layer comprising:

(a) at least one fold in said film, said fold being adjacent a film edge which forms said opening, said fold providing direct contact between two surface areas of said outer layer;

(b) a seal between said two surface areas, said seal being located between said fold and said film edge and said seal closing said opening; and, (c) said fold providing a tab which may be pulled to rupture one of said outer layers at said seal and causing said outer layer to delaminate from its adjacent layer to the edge of the film thereby opening said receptacle.

2. The closure seal of claim 1 wherein the outer surface layer material is selected from the group comprising polyethylene and ethylene-vinyl acetate copolymers and the material of the adjacent layer is selected from the group consisting of nylon, vinylidene chloride copolymers; propylene homopolymers and copolymers; and, cross-linked polyethylene and ethylene-vinyl acetate copolymers.

3. The closure seal of claim 1 wherein said film comprises three layers, the outer layer comprising an ethylene vinyl acetate copolymer, a middle layer comprising a copolymer of vinylidene chloride, and an outer layer comprising a cross-linked copolymer of ethylene and vinyl acetate.

4. A package having an easy-open seal comprising:

(a) a product;

(b) a receptacle of flexible film enclosing said product, said film having at least two layers, the tensile strength of the outer layer being greater than the bond strength between the outer layer and its adjacent layer;

(c) a seal closing one side of said receptacle, said seal being formed by opposed edges of said receptacle inwardly folded over at coinciding fold lines so that the surface of the outer layers of said film are directly sealed to each other and surfaces of the inner layer of said film are sealed together, all of said surface-to-surface seals being in-line within the same seal area located between the fold lines and product whereby the folded over edges provide tabs which may be pulled apart rupturing one of the outer layers and causing it to delaminate from its adjacent layer, said delamination extending from the seal area to the edge of the film thereby opening said receptacle.

5. The package of claim 4 wherein the outer layer is selected from the group comprising polyethylene and ethylene-vinyl acetate copolymers and the adjacent layer is selected from the group consisting of nylon, vinylidene chloride copolymers; propylene homopolymers and copolymers; and cross-linked polyethylene and ethylene-vinyl acetate copolymers.

6. A method of making an easy open closure seal for an opening in a flexible receptacle of thermoplastic film, said film having at least two layers wherein the tensile strength of the outer surface layer is greater than the bond strength between the outer layer and its adjacent layer comprising the steps of:

(a) folding the film adjacent an edge which forms said opening along a fold line so that surface areas of said outer layers are in direct contact;

(b) heat sealing said surface areas together to close said opening, said seal being located between said film edge and fold line thereby forming a pull tab by said film folded at the fold line whereby when said tab is pulled the outer layer will rupture and delaminate from the adjacent layer, said delamination continuing to said edge of said film to open said package.

7. The method of claim 6 wherein the outer surface layer material is selected from the group consisting of polyethylene and ethylene-vinyl acetate copolymer and the adjacent layer material is selected from the group consisting of vinylidene chloride copolymers, propylene homopolymers and copolymers; and cross-linked polyethylene and ethylene-vinyl acetate copolymers.

* * * * *